US012808625B2

(12) United States Patent
Chu et al.

(10) Patent No.: US 12,808,625 B2
(45) Date of Patent: Nov. 24, 2026

(54) STABLE ARROW-DROPPING STRUCTURE

(71) Applicant: MAN KUNG ENTERPRISE CO., LTD., Taichung (TW)

(72) Inventors: Fu-Hui Chu, Taichung (TW); Ching-Chi Hung, Taichung (TW)

(73) Assignee: MAN KUNG ENTERPRISE CO., ITD., Taichung (TW)

( * ) Notice: Subject to any disclaimer, the term of this patent is extended or adjusted under 35 U.S.C. 154(b) by 122 days.

(21) Appl. No.: 19/019,982

(22) Filed: Jan. 14, 2025

(65) Prior Publication Data

US 2026/0202161 A1 Jul. 16, 2026

(51) Int. Cl.
*F41B 5/12* (2006.01)

(52) U.S. Cl.
CPC ..... *F41B 5/126* (2013.01)

(58) Field of Classification Search
None
See application file for complete search history.

(56) References Cited

U.S. PATENT DOCUMENTS 1,985,079 A * 12/1934 Conklin ..... F41B 7/006 124/25
2,516,341 A * 7/1950 Raffeis ..... F41B 5/12 124/35.1
3,968,783 A * 7/1976 Pfotenhauer ..... F41B 5/126 124/40
5,544,641 A * 8/1996 Jenn ..... F41G 1/467 124/52
6,868,845 B1 * 3/2005 Moore ..... F41B 5/10 124/25
2022/0026171 A1 * 1/2022 Liu ..... F41B 5/126
2022/0049921 A1 * 2/2022 Liu ..... F41B 5/126
2022/0113107 A1 * 4/2022 Liu ..... F41B 5/126
2022/0412687 A1 * 12/2022 Liu ..... F41B 5/126
2023/0235988 A1 * 7/2023 Liu ..... F41B 5/126 124/25
2023/0332859 A1 * 10/2023 Liu ..... F41B 5/126
2025/0198723 A1 * 6/2025 Liu ..... F41B 5/126
2025/0271234 A1 * 8/2025 Chu ..... F41B 5/126
2025/0321072 A1 * 10/2025 Liu ..... F41B 11/89

* cited by examiner

*Primary Examiner* — Tye William Abell
(74) *Attorney, Agent, or Firm* — Demian K. Jackson; Jackson IPG PLLC

(57) ABSTRACT

A stable arrow-dropping structure of an arrow magazine contains a bow, an arrow magazine, a stopper, and a returning means. The bow includes a fixing platform and a bowstring. The arrow magazine includes is received at a top of the fixing platform of the bow. The arrow magazine includes a receiving channel configured to accommodate multiple arrows, and a respective one arrow has a point and two fletchings. The arrow magazine also includes a slide rail formed between the arrow magazine and the fixing platform so as to slide the bowstring in the slide rail. The stopper is disposed on the bow and is controlled to move between a stopping position and a releasing position. The returning means is configured to abut against the stopper so as to maintain the stopper at the stopping position normally.

8 Claims, 20 Drawing Sheets

STABLE ARROW-DROPPING STRUCTURE

TECHNICAL FIELD

The present invention relates to an arrow magazine, and more particularly to a stable arrow-dropping structure of the arrow magazine.

BACKGROUND

A common bow and arrow include a bowstring, a gun body, a trigger and multiple arrows. The shooting process must be smooth and unobstructed for archers to avoid external interference. The steps of drawing and setting the arrow are eliminated to simplify the shooting process, thus maintaining an extremely high accuracy and stability. Many shooters choose a crossbow with an arrow magazine to allow the multiple arrows to be automatically loaded, thus eliminating the process of extracting and positioning each arrow to enhance a shooting accuracy and stability. It also can reduce a risk of decreased accuracy or misjudgment because of external factors.

Referring to FIGS. 18-20, a conventional arrow magazine of a crossbow, the arrow magazine 80 is disposed on the crossbow 90, and the crossbow includes a fixing platform 91, a bowstring 92 passing above the fixing platform 91, a retainer 93 received in the crossbow 90 and located adjacent to a rear end of the crossbow 90. The arrow magazine 80 is an elongated box and it includes a receiving channel 81 passing to a bottom of the arrow magazine 80 from a top of the arrow magazine 80, wherein the receiving channel 81 is communicated with the fixing channel 91 of the crossbow 90 and is configured to accommodate multiple arrows 82 which are stacked, a respective one arrow 82 has a point 821, and a slide rail 83 is defined between the arrow magazine 80 and the fixing platform 91, and the bowstring 92 is movable along the slide rail 83.

When shooting the arrow 82, the bowstring 92 is pulled to the retainer 93 in the slide rail 83 so as to pass through a bottommost arrow 82 and the slide rail 83 until it is engaged on the retainer 93. In the meantime, the bottommost arrow 82 is removed from the bowstring 92 to drop on the fixing platform 91, thus shooting the bottommost arrow 82. The other arrows are shot as in the above-mentioned description. For example, a new arrow 82 is dropped on the fixing platform 91 to be shot successively to decrease an arrow drawing and fixing, thus enhancing a shooting efficiency.

However, when the bowstring 92 is pulled halfway to occur a special circumstance (such as a target moves or a shooter is nervous or hesitant, etc.), it will be released, then the bottommost arrow 82 in the receiving channel 81 is tilted at an angle to be pulled forward by the bowstring 92 (as shown in FIG. 20), thus causing an abrasion of the bottommost arrow 82. Furthermore, the bottommost arrow 82 is blocked in the arrow magazine 80 to have a safety hazard.

The present invention has arisen to mitigate and/or obviate the afore-described disadvantages.

SUMMARY

The primary aspect of the present invention is to provide a stable arrow-dropping structure of an arrow magazine by which when a bowstring is pulled halfway and released, a bottommost arrow of an arrow magazine is not actuated by the bowstring to move forward, hence an abrasion of the bottommost arrow is decreased, and the bottommost arrow is not blocked in the arrow magazine, thus shooting the arrow smoothly and enhancing a using convenience and safety.

To obtain the above-mentioned aspect, a stable arrow-dropping structure of an arrow magazine provided by the present invention contains: a bow, an arrow magazine, a stopper, and a returning means.

The bow includes a fixing platform and a bowstring passing above the fixing platform.

The arrow magazine includes a front end and a rear end and is received on a top of the fixing platform of the bow. The arrow magazine includes a receiving channel extending from a top to a bottom of the arrow magazine so as to accommodate multiple arrows, and a respective one arrow has a point formed on an end thereof and two fletchings formed on the other end of the respective one arrow. The arrow magazine also includes a slide rail formed between the arrow magazine and the fixing platform so as to slide the bowstring in the slide rail.

The stopper is disposed on the bow and is controlled to move between a stopping position and a releasing position. When the stopper is located at the stopping position, the stopper stops the two fletchings of the respective one arrow of the arrow magazine to prevent a dropping of the bottommost arrow.

The returning means is configured to abut against the stopper so as to maintain the stopper at the stopping position normally.

DETAILED DESCRIPTION

Figure 1:
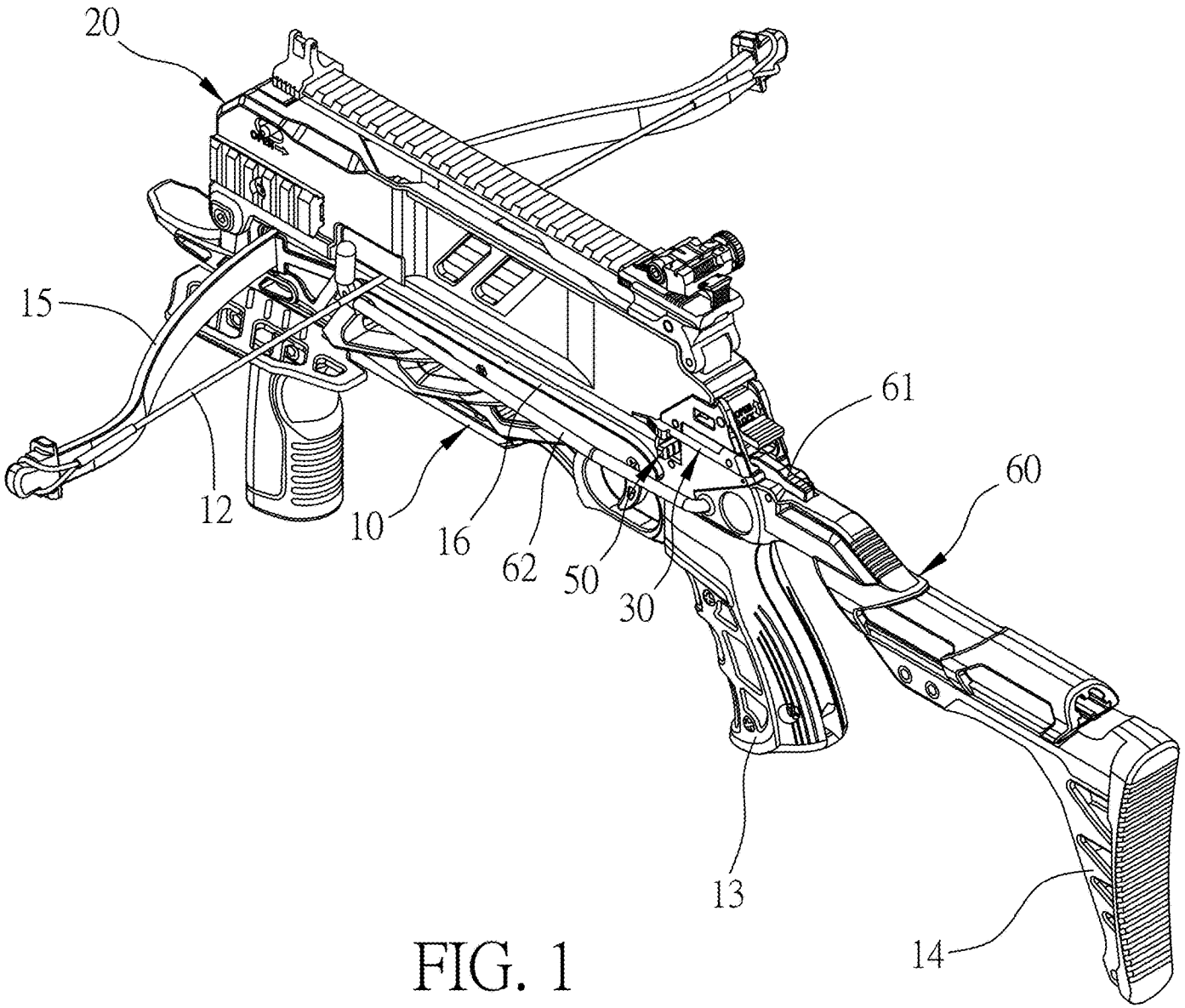
FIG. 1 is a perspective view showing the assembly of a stable arrow-dropping structure of an arrow magazine according to a preferred embodiment of the present invention.
Figure 2:
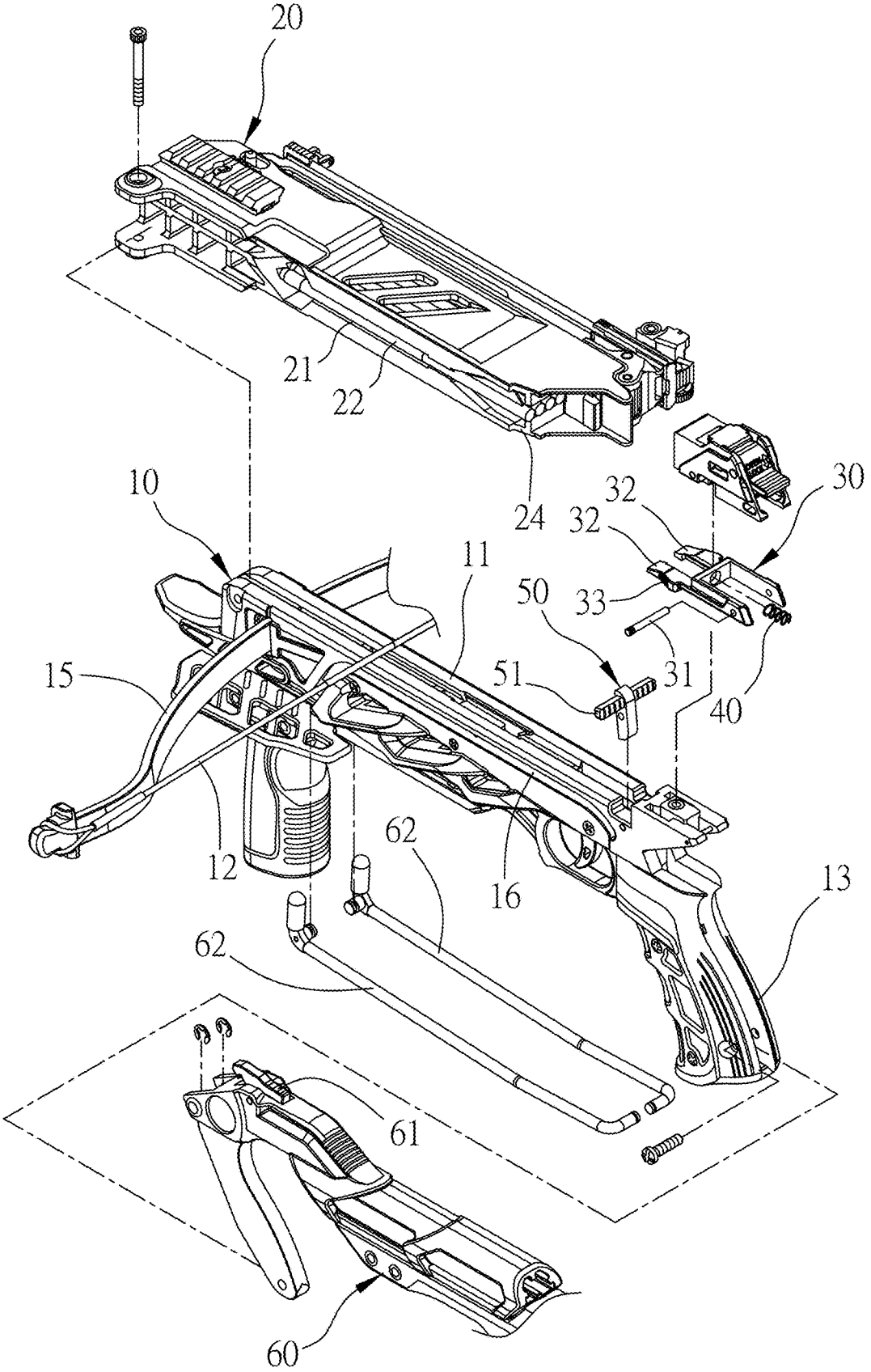
FIG. 2 is a perspective view showing the exploded components of the stable arrow-dropping structure of the arrow magazine according to the preferred embodiment of the present invention.
Figure 3:
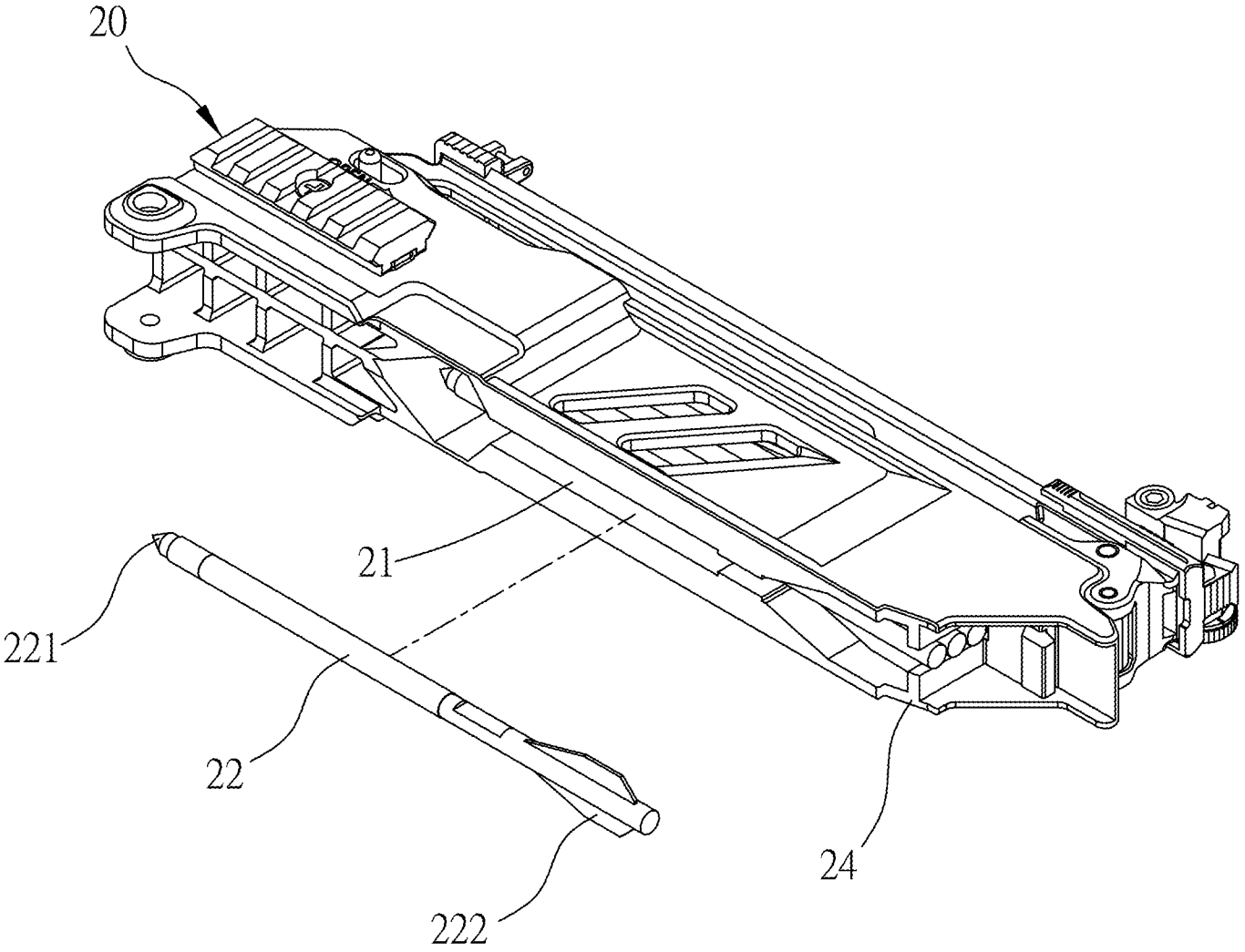
FIG. 3 is a perspective view showing the exploded components of an arrow magazine of the stable arrow-dropping structure according to the preferred embodiment of the present invention.

With reference to FIGS. 1-8, a stable arrow-dropping structure of an arrow magazine according to a preferred embodiment of the present invention comprises: a bow 10, the arrow magazine 20, a stopper 30, a returning means 40, a safety switch 50, and a string puller 60.

The bow 10 includes a fixing platform 11, a bowstring 12 passing above the fixing platform 11, a grip 13, and a butt stock 14. In this embodiment, the bow 10 is a crossbow, two ends of the bowstring 12 are connected on two ends of a bow limb 15, and the bow limb 15 is located adjacent to a front end of the bow 10, the grip 13 and the butt stock 14 are located proximate to a rear end of the bow 10, and the bow 10 includes two guide grooves 16 defined on two sides thereof.

The arrow magazine 20 is received at a top of the fixing platform 11 of the bow 10 and it includes a front end and a rear end, wherein the arrow magazine 20 includes a receiving channel 21 extending from a top to a bottom of the arrow magazine 20 so as to accommodate multiple arrows 22 which are stacked, a respective one arrow 22 has a point 221 formed on an end thereof and facing the front end of the arrow magazine 20, two fletchings 222 formed on the other end of the respective one arrow 22 and facing the rear end of the arrow magazine 20. The arrow magazine 20 also includes a slide rail 23 formed between the arrow magazine 20 and the fixing platform 11 so as to slide the bowstring 12 in the slide rail 23, and the arrow magazine 20 includes a cutout 24 facing the butt stock 14 and communicated with the receiving channel 21.

Figure 4:
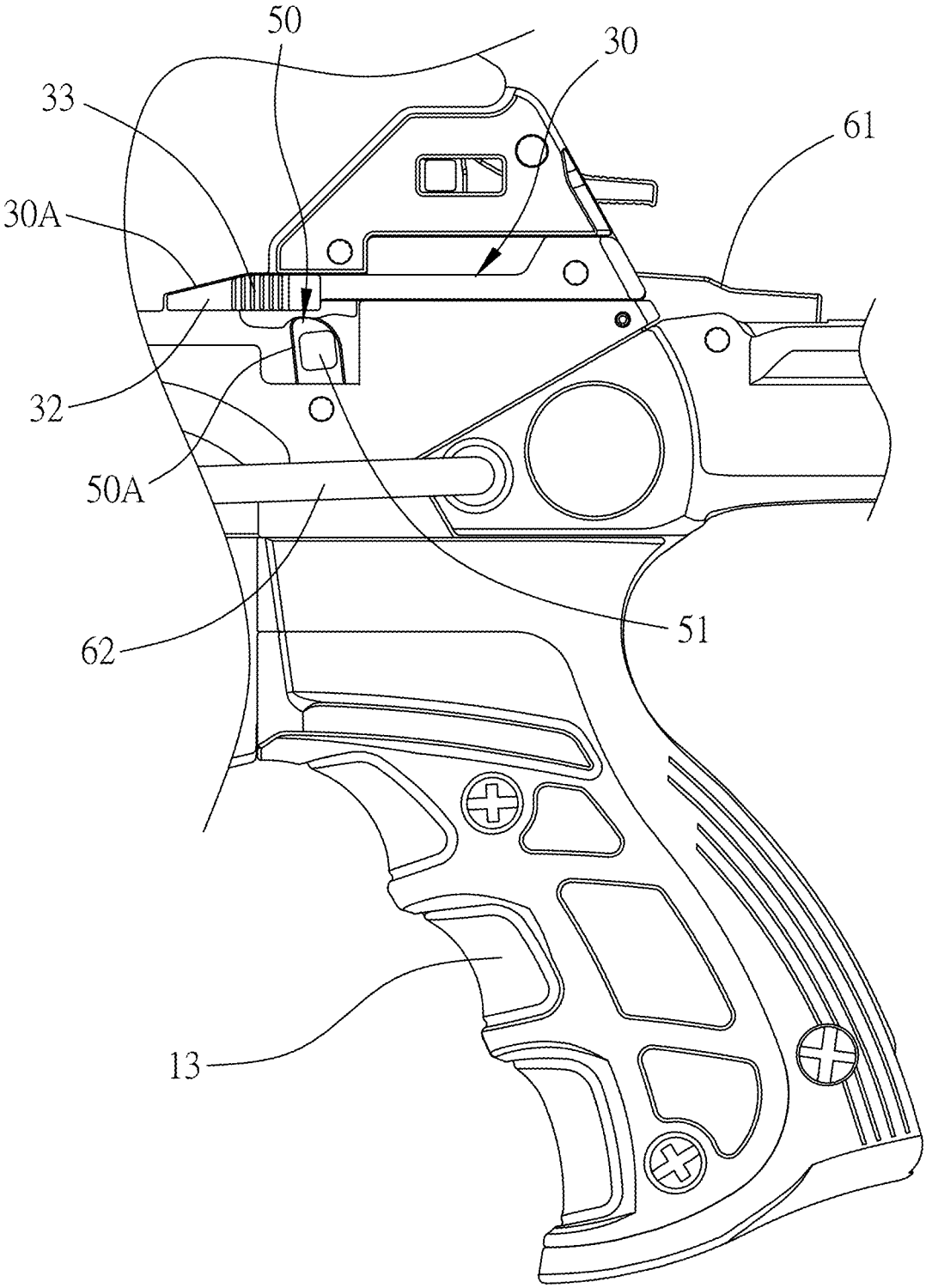
FIG. 4 is a side plan view showing the assembly of a stopper of the stable arrow-dropping structure according to the preferred embodiment of the present invention.
Figure 5:
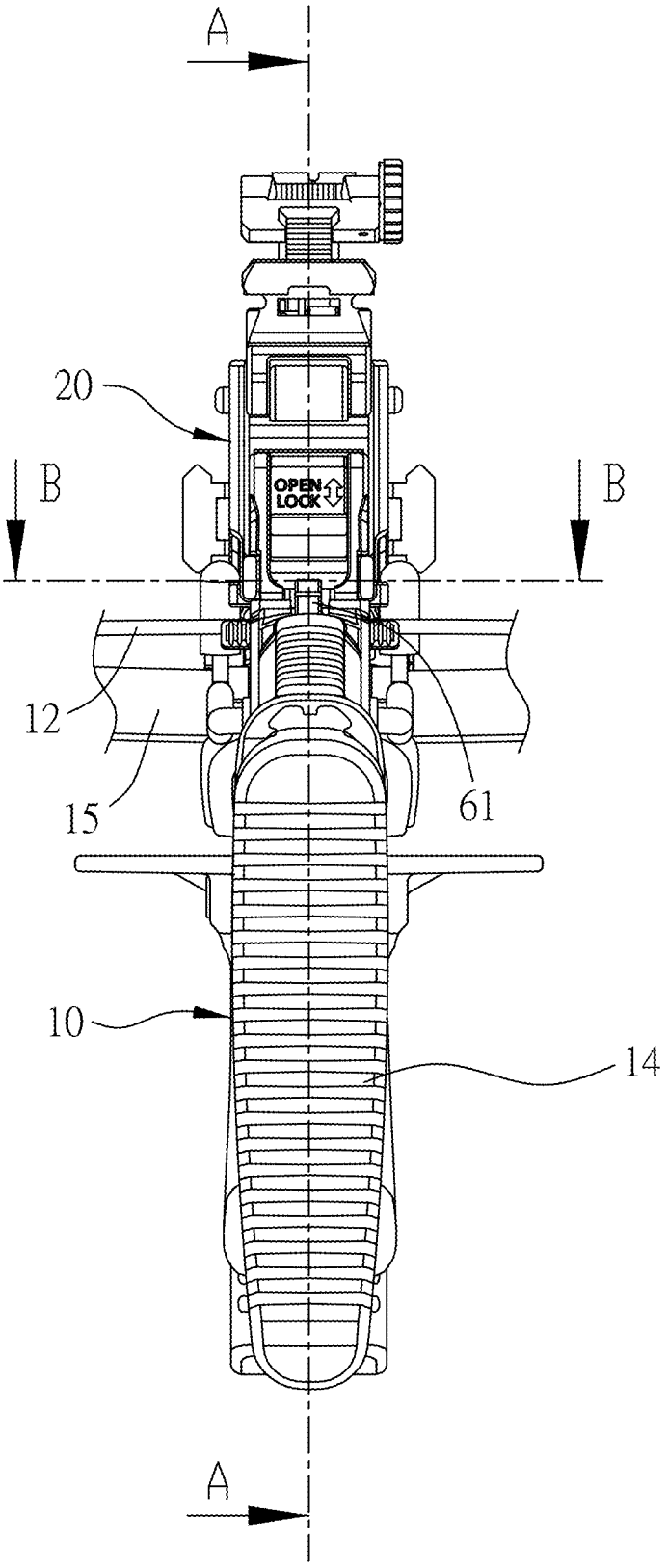
FIG. 5 is another side plan view showing the assembly of the stopper of the stable arrow-dropping structure according to the preferred embodiment of the present invention.
Figure 6:
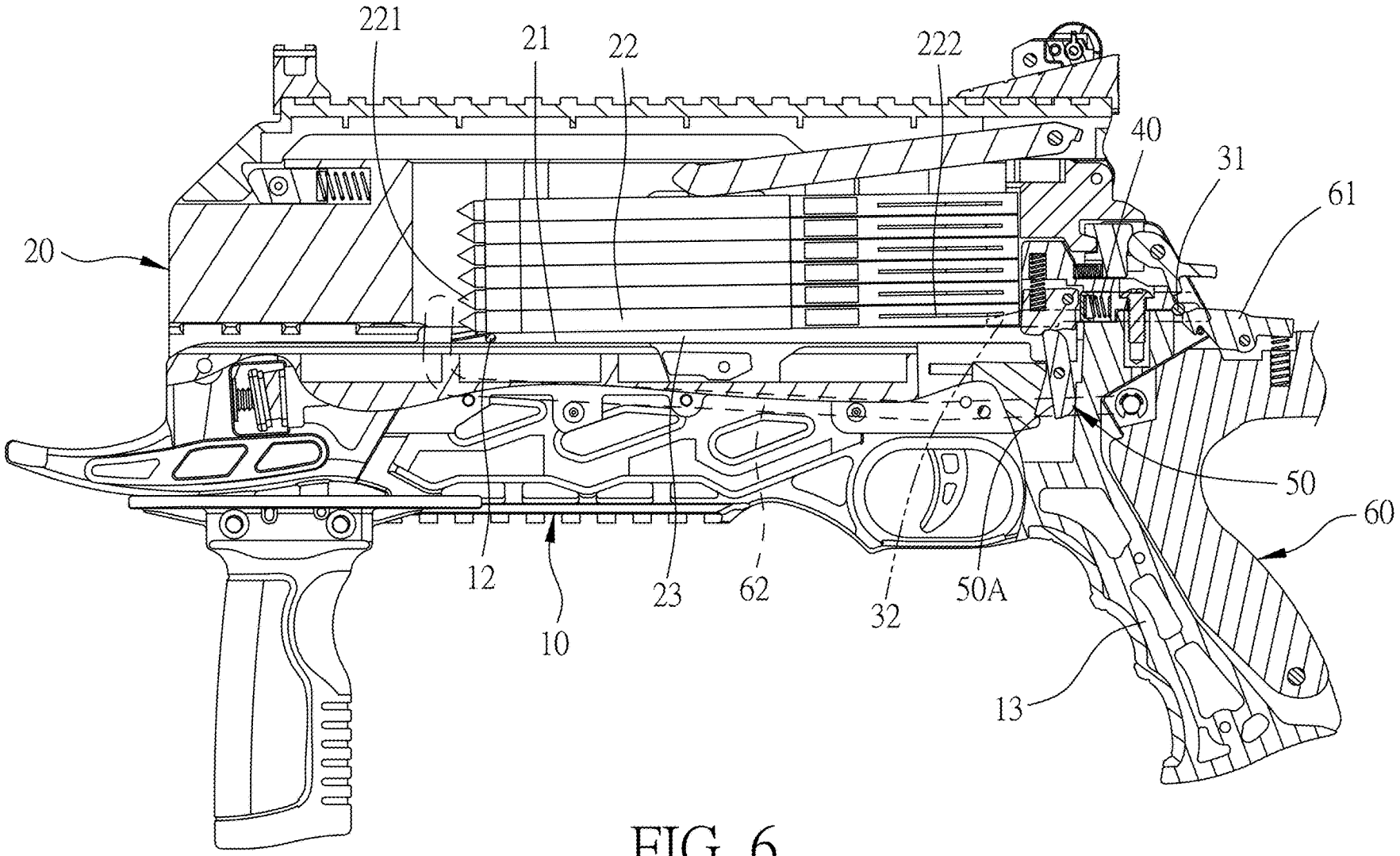
FIG. 6 is a cross-sectional view taken along the line A-A of FIG. 5.
Figure 8:
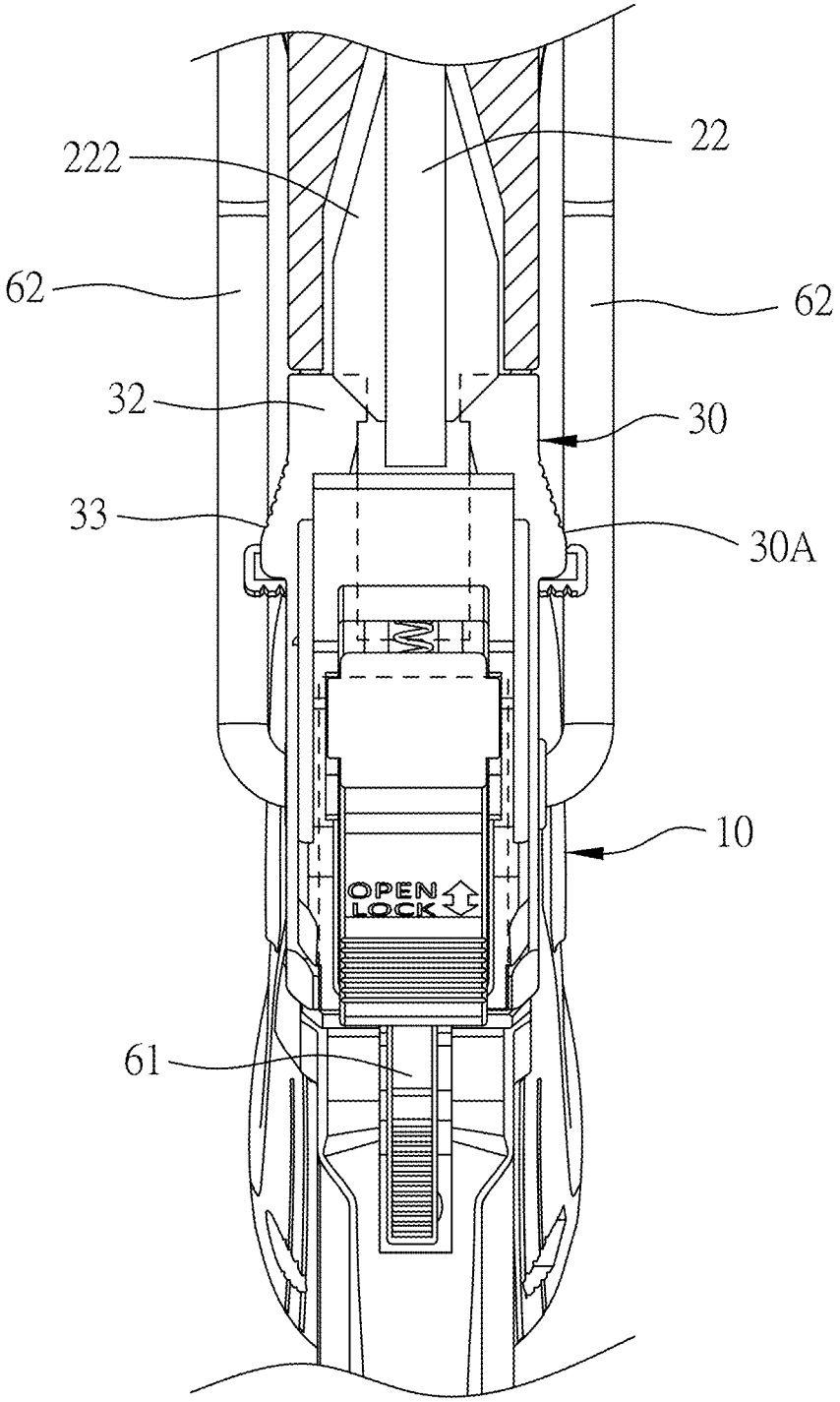
FIG. 8 is a cross-sectional view showing the assembly of a part of the stable arrow-dropping structure according to the preferred embodiment of the present invention.
Figure 13:
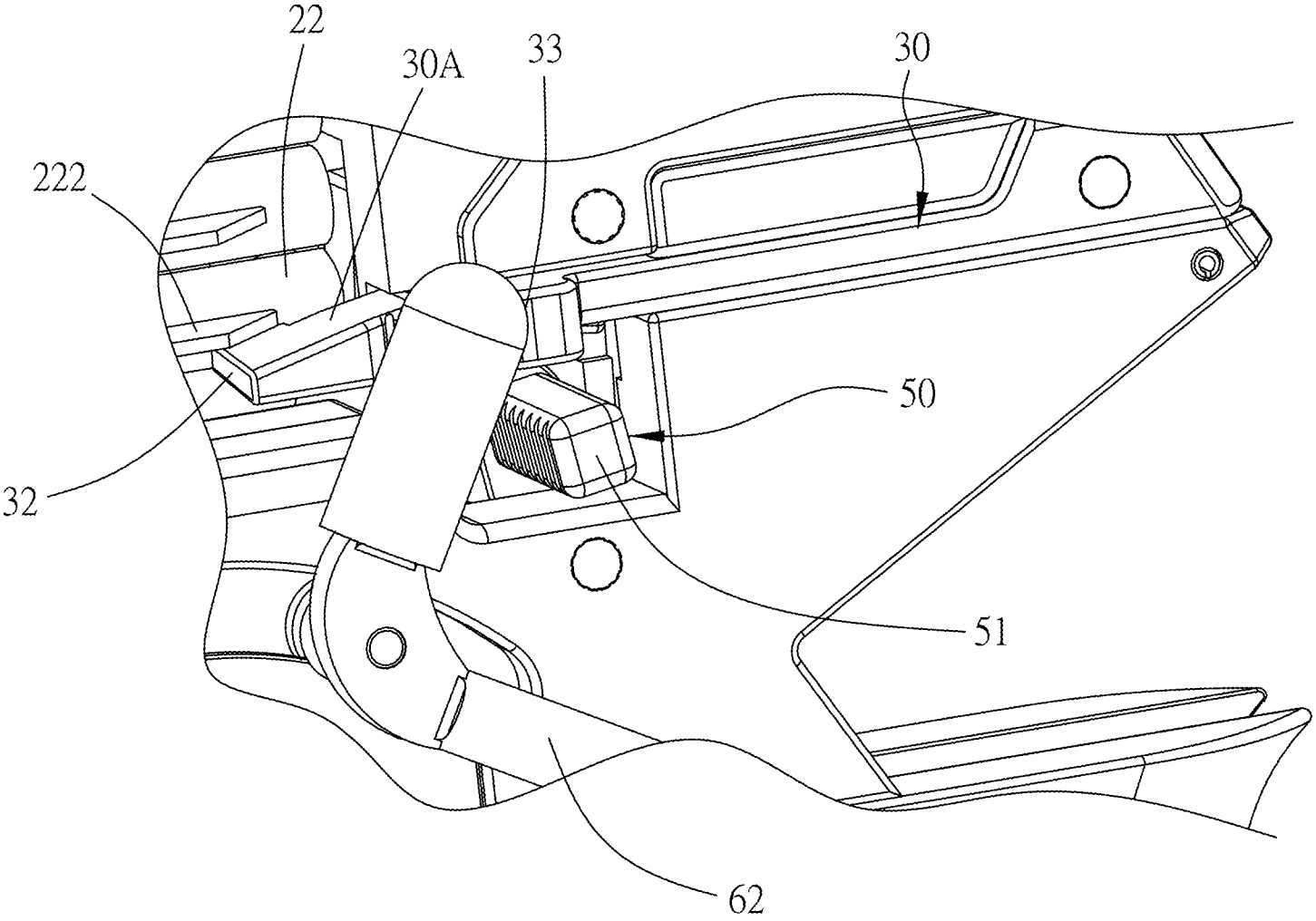
FIG. 13 is another side plan view showing the operation of the stable arrow-dropping structure according to the preferred embodiment of the present invention.
Figure 14:
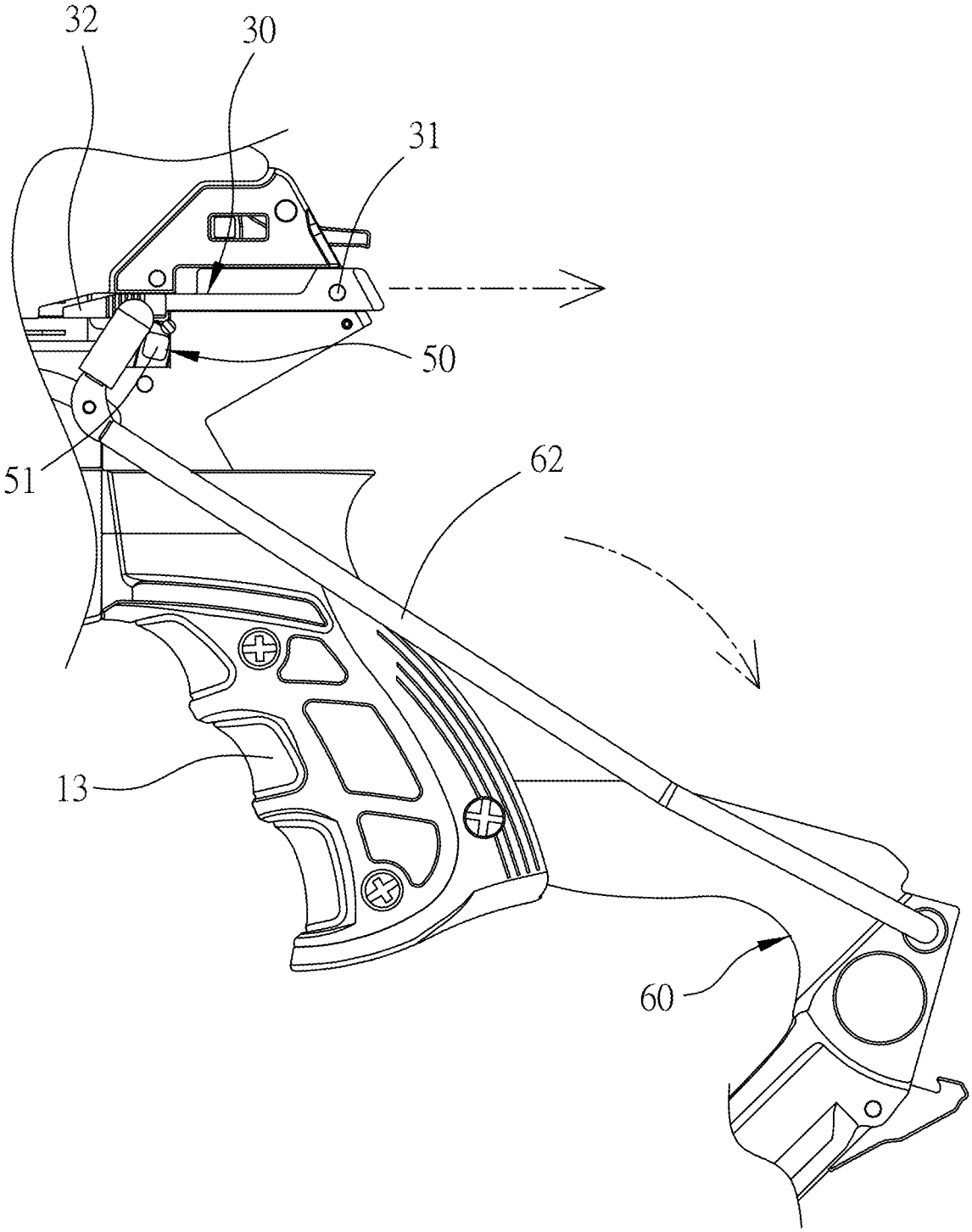
FIG. 14 is also another side plan view showing the operation of the stable arrow-dropping structure according to the preferred embodiment of the present invention.
Figure 15:
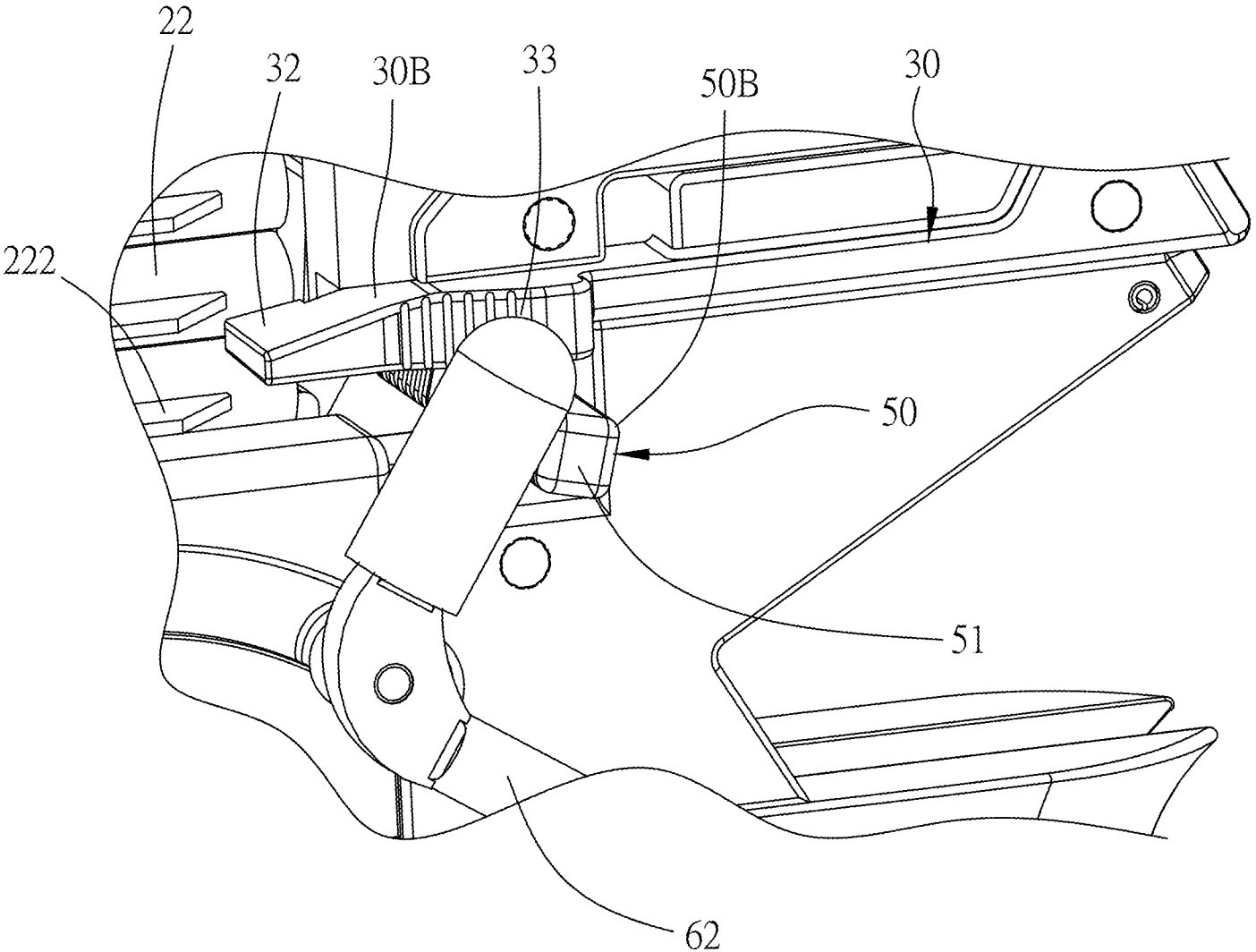
FIG. 15 is still another side plan view showing the operation of the stable arrow-dropping structure according to the preferred embodiment of the present invention.
Figure 17:
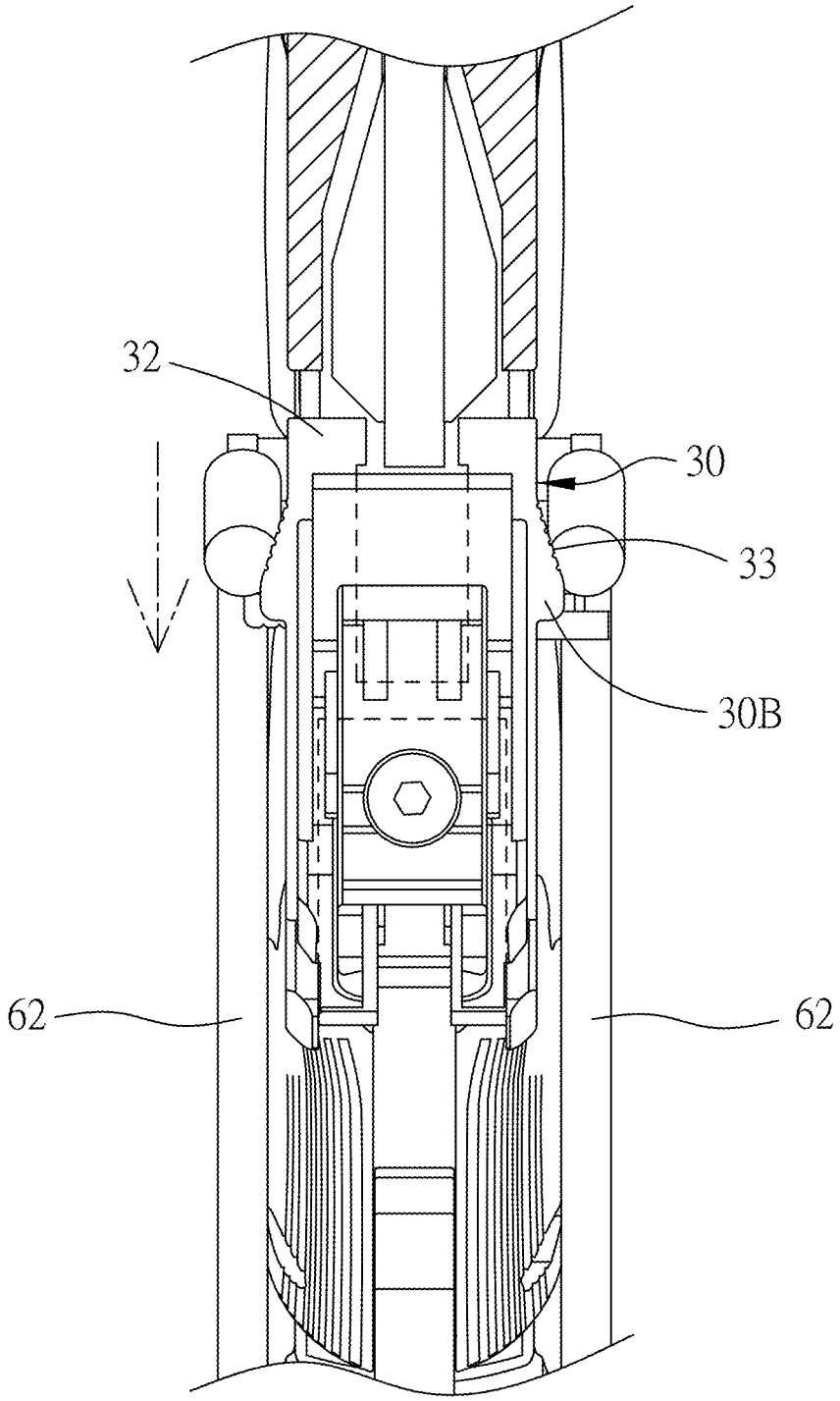
FIG. 17 is also another cross-sectional view showing the operation of the stable arrow-dropping structure according to the preferred embodiment of the present invention.
Figure 18:
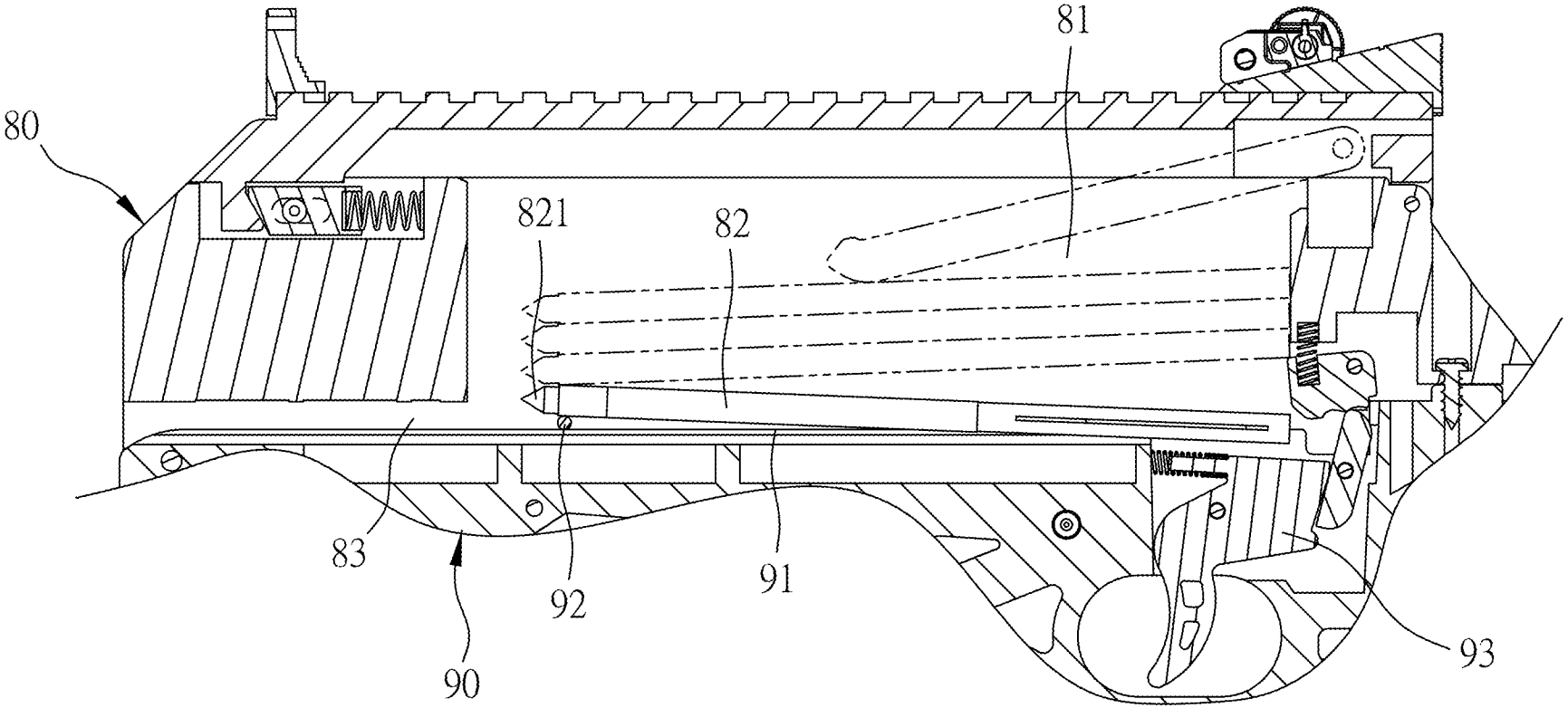
FIG. 18 PRIOR ART
FIG. 18 is a cross-sectional view of a conventional arrow magazine of a crossbow.
Figure 19:
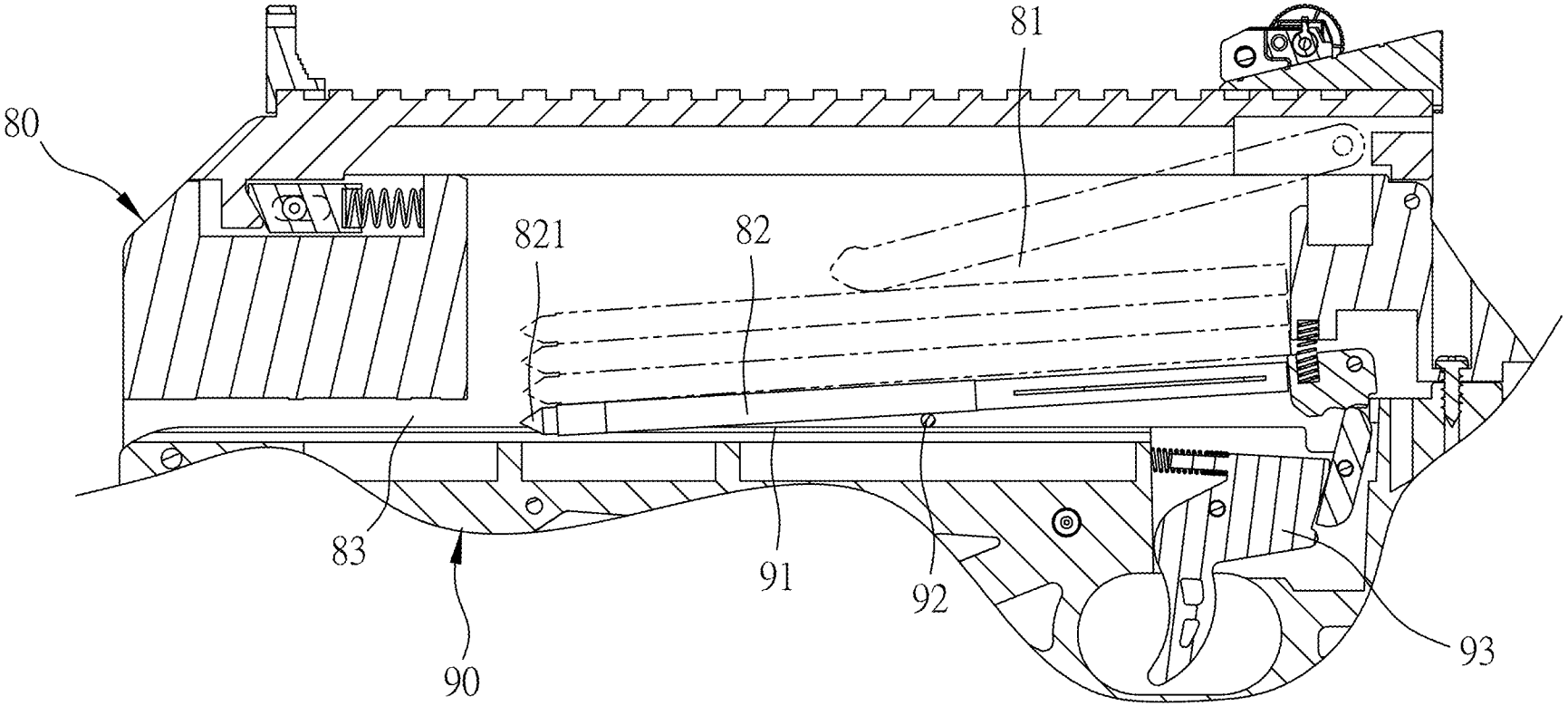
FIG. 19 PRIOR ART
FIG. 19 is a cross-sectional view showing the operation of the conventional arrow magazine of the crossbow.
Figure 20:
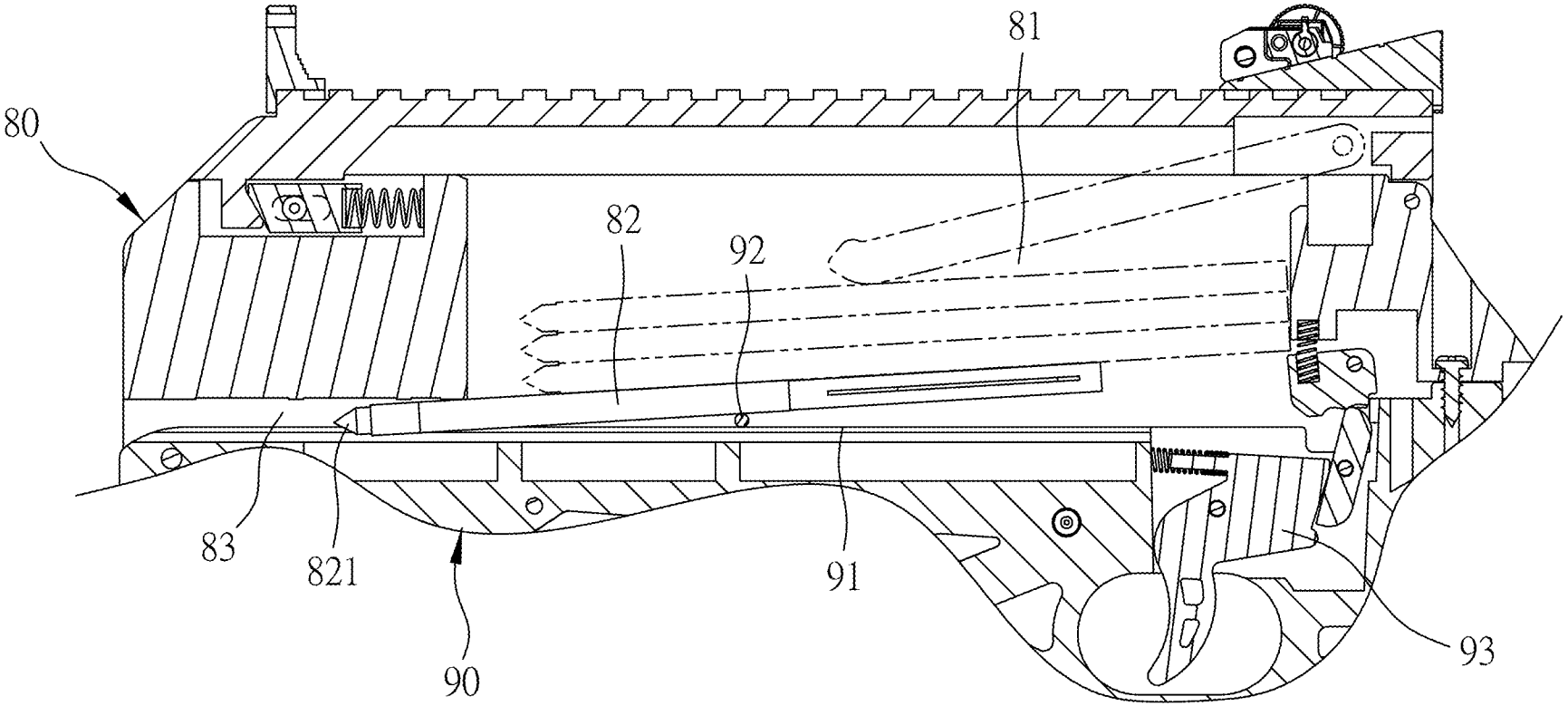
FIG. 20 PRIOR ART
FIG. 20 is another cross-sectional view showing the operation of the conventional arrow magazine of the crossbow.

The stopper 30 is disposed on the bow 10 and corresponds to a bottom of a rear end of the receiving channel 21 of the arrow magazine 20, wherein the stopper 30 is controlled to move between a stopping position 30A (as shown in FIGS. 4, 8 and 13) and a releasing position 30B (as illustrated in FIGS. 15 and 17). When the stopper 30 is located at the stopping position 30A, the stopper 30 stops the two fletchings 222 of a bottommost arrow 22 of the arrow magazine 20 to prevent a dropping of the bottommost arrow 22. In this embodiment, the stopper 30 includes a defining post 31 inserted through, two stop arms 32 facing the two bow limbs 15 (i.e. the front end of the arrow magazine 20) and accommodated in the cutout 24 of the arrow magazine 20, and two pushed portions 33 extending out of the two sides of the bow 10.

The returning means 40 is configured to abut against the stopper 30 so as to maintain the stopper 30 at the stopping position 30A normally. In this embodiment, the returning means 40 is a spring.

Figure 7:
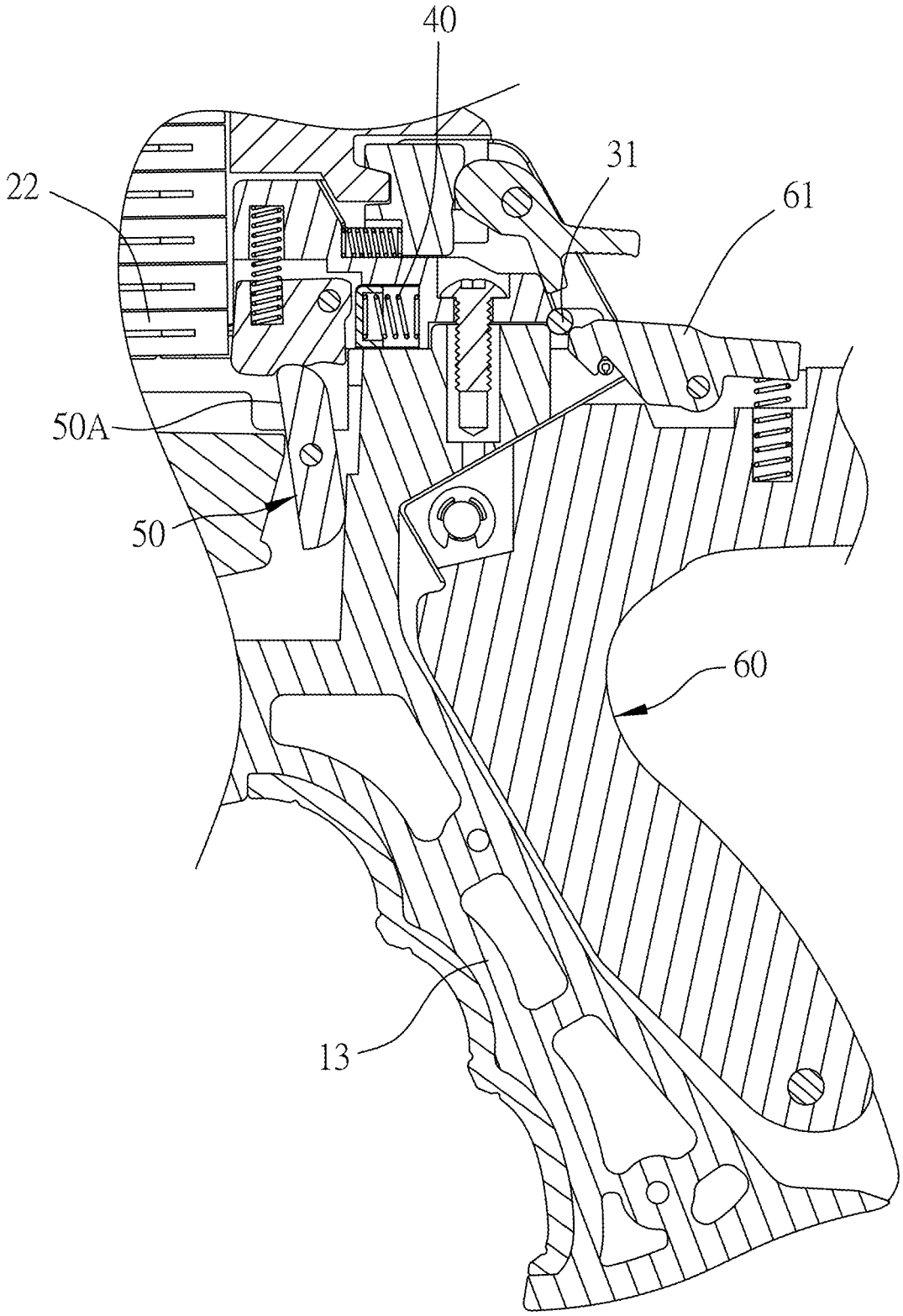
FIG. 7 is a cross-sectional view taken along the line B-B of FIG. 5
Figure 9:
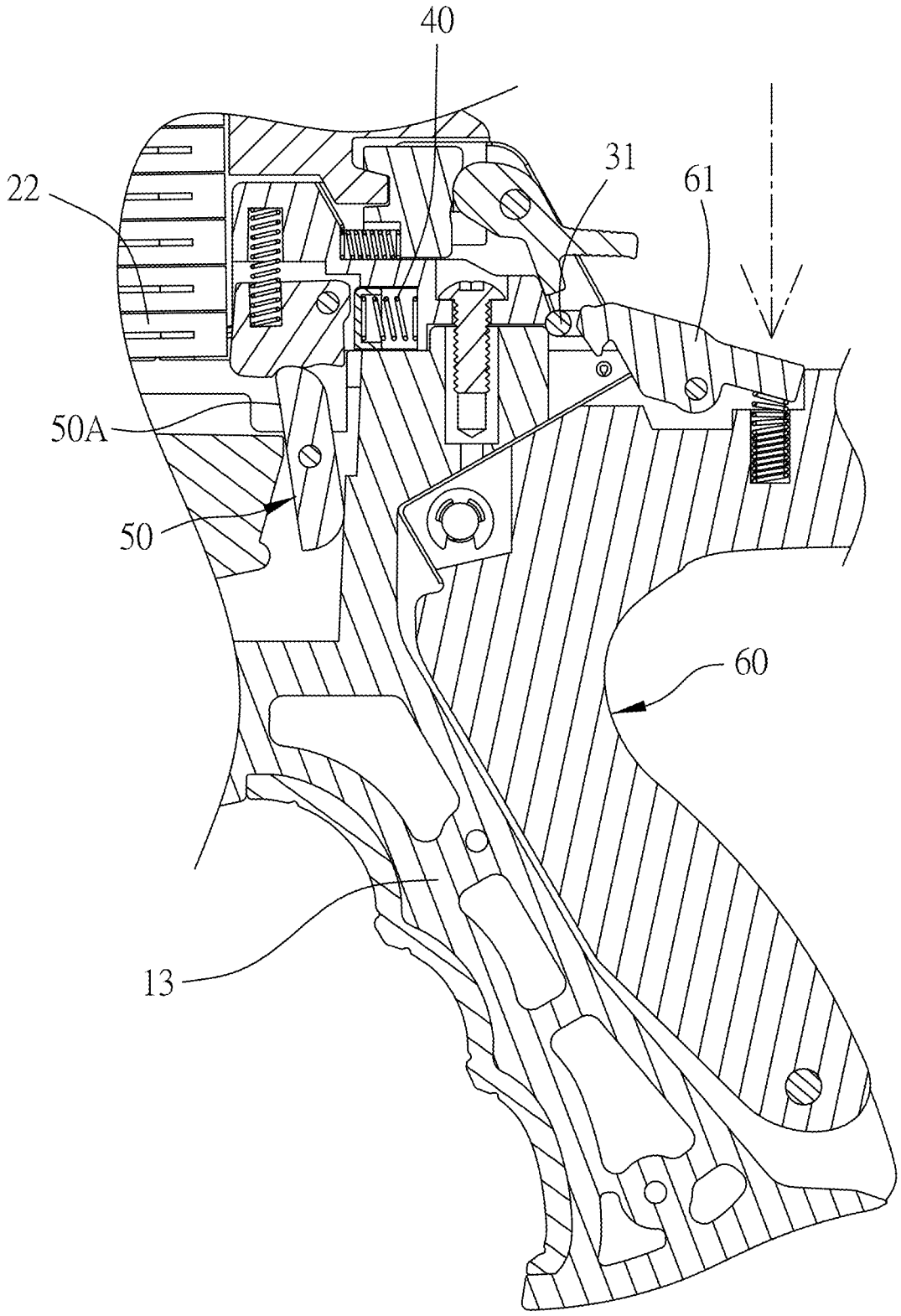
FIG. 9 is a cross-sectional view showing the operation of the stable arrow-dropping structure according to the preferred embodiment of the present invention.
Figure 16:
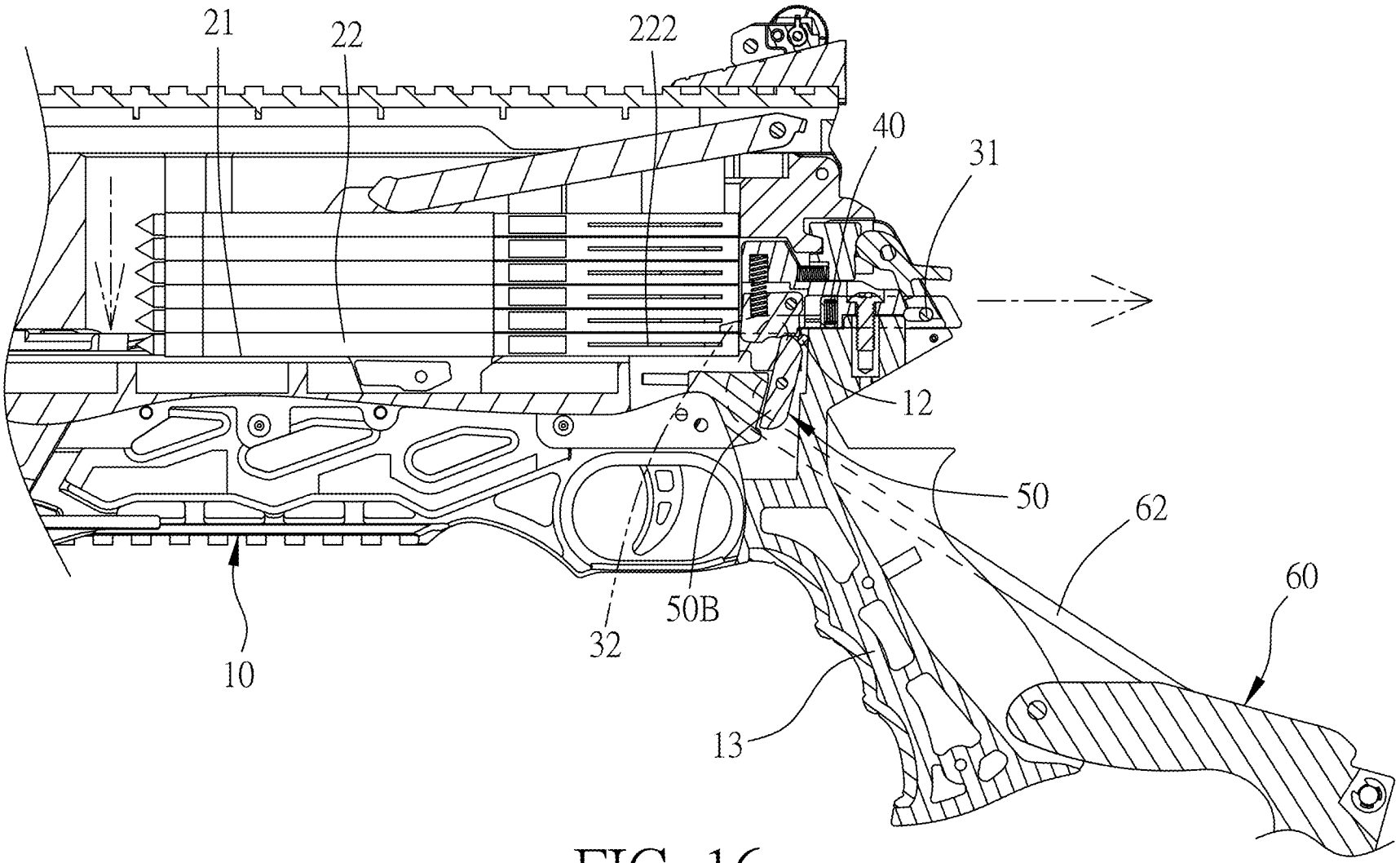
FIG. 16 is another cross-sectional view showing the operation of the stable arrow-dropping structure according to the preferred embodiment of the present invention.

The safety switch 50 is fixed below the stopper 30 and is controlled to shift between a closing position 50A (as shown in FIGS. 4, 7 and 9) and an opening position 50B (as illustrated in FIGS. 15 and 16), wherein the safety switch 50 includes two columns 51 extending out of the two sides of the bow 10.

The string puller 60 is connected to the bow 10 and is configured to pull the bowstring 12 tightly, drive the stopper 30 to move to the releasing position 30B, and shift the safety switch 50 to the opening position 50B. In this embodiment, the string puller 60 is connected between the grip 13 and the butt stock 14 includes a fastening sheet 61 and two pull bars 62, wherein the fastening sheet 61 is engaged on the bow 10 and is fixed to stop the defining post 31 of the stopper 30, such that the stopper 30 is mounted at the stopping position 30A to avoid an abnormal operation of the stopper 30. The two pull bars 62 are rotatably received and slide in the two guide grooves 16 of the bow 10.

Figure 10:
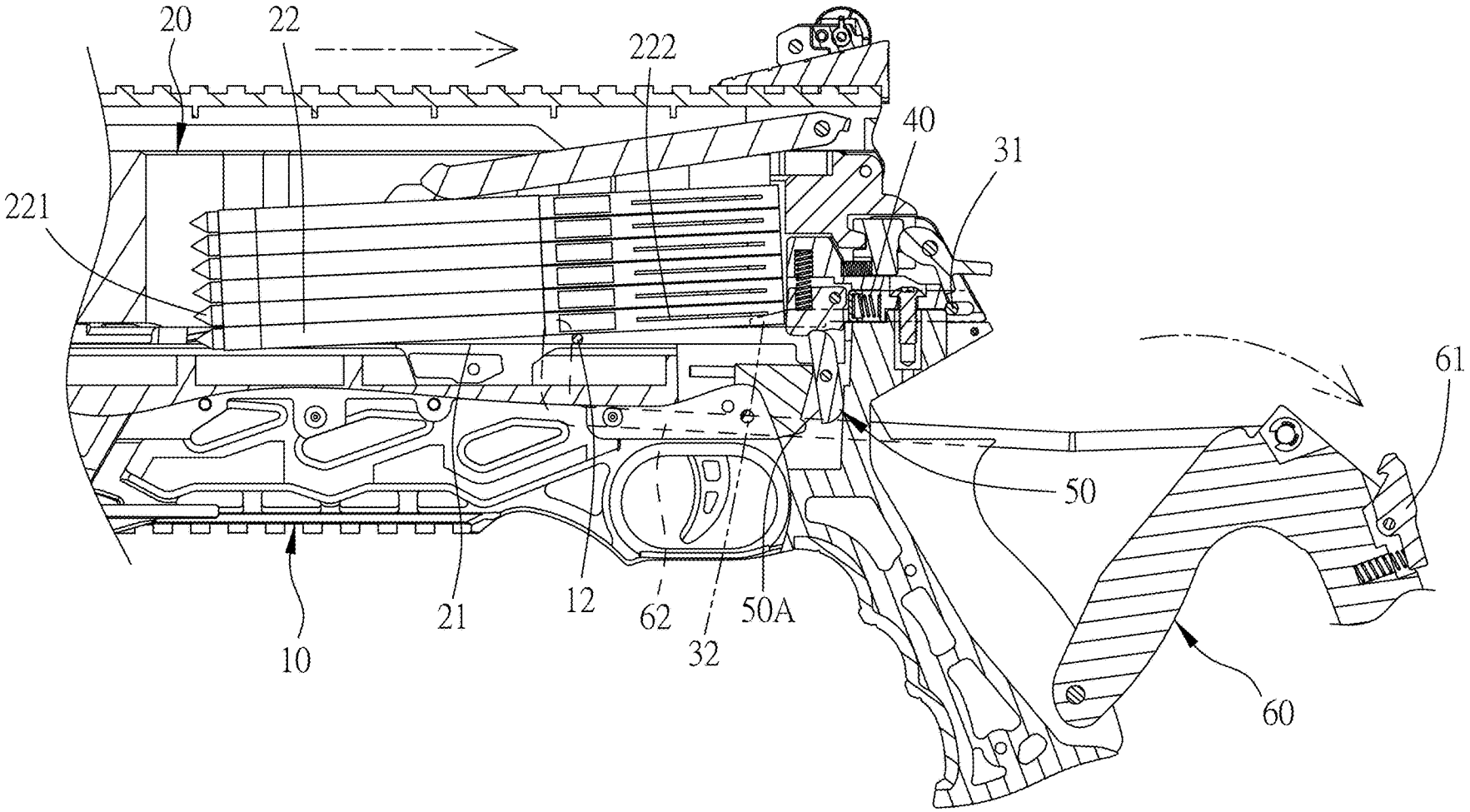
FIG. 10 is another cross-sectional view showing the operation of the stable arrow-dropping structure according to the preferred embodiment of the present invention.
Figure 11:
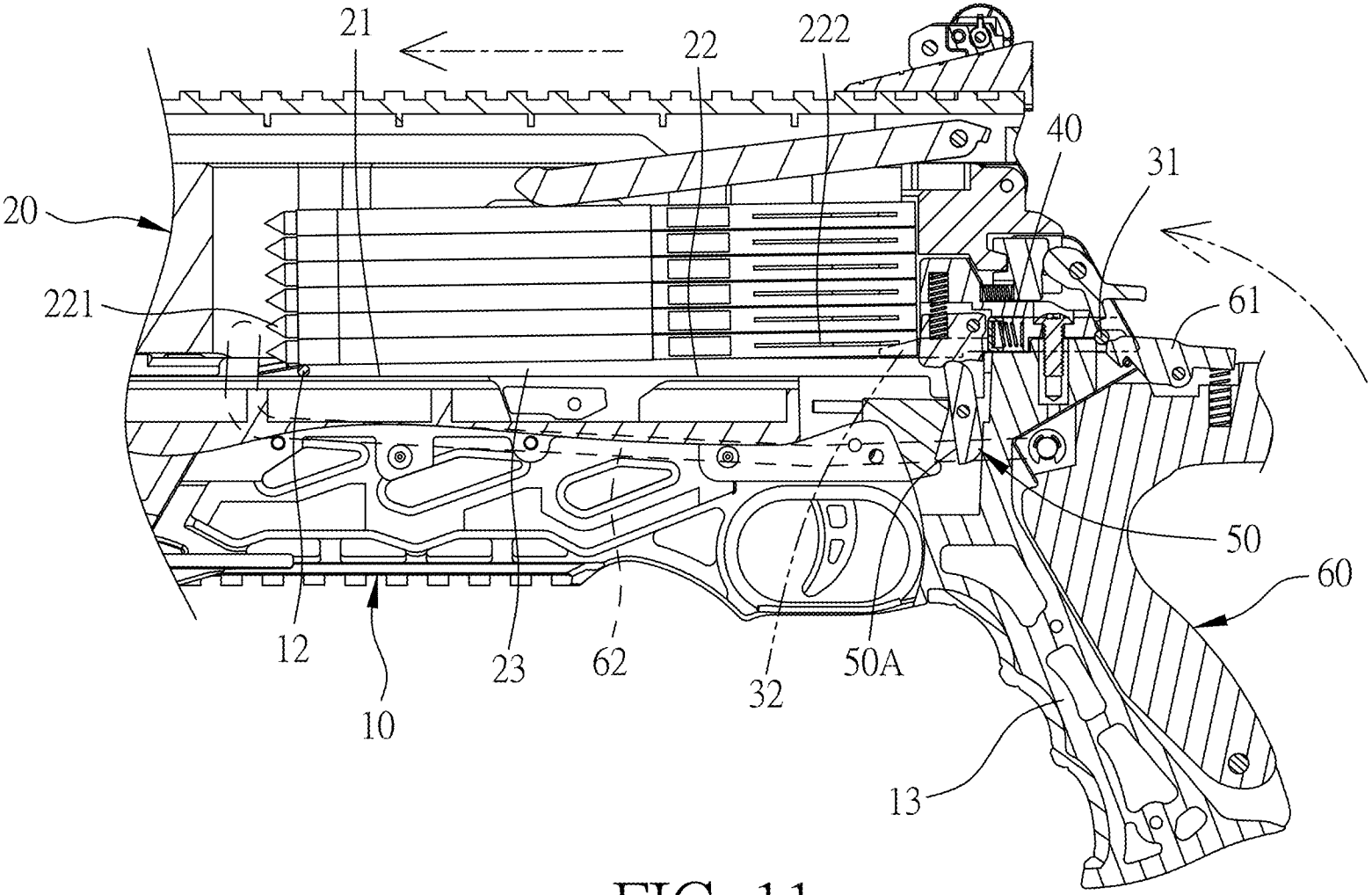
FIG. 11 is also another cross-sectional view showing the operation of the stable arrow-dropping structure according to the preferred embodiment of the present invention.

When pulling the string, as shown in FIG. 9, the fastening sheet 61 of the string puller 60 is pressed to remove from the bow 10. As shown in FIG. 10, the butt stock 14 actuates the string puller 60 to move the two pull bars 62 of the string puller 60 along the two guide grooves 16 so that the bowstring 12 is pulled. When the bowstring 12 is pulled halfway and a special circumstance occurs (such as a target moves or a shooter is nervous or hesitant, etc.) to let go of the bowstring 12, since the two fletchings 222 of the bottommost arrow 22 of the arrow magazine 20 are stopped by the stopper 30, the bowstring 12 returns back to an original position, and the bottommost arrow 22 of the arrow magazine 20 is pulled forward, as illustrated in FIG. 11.

Figure 12:
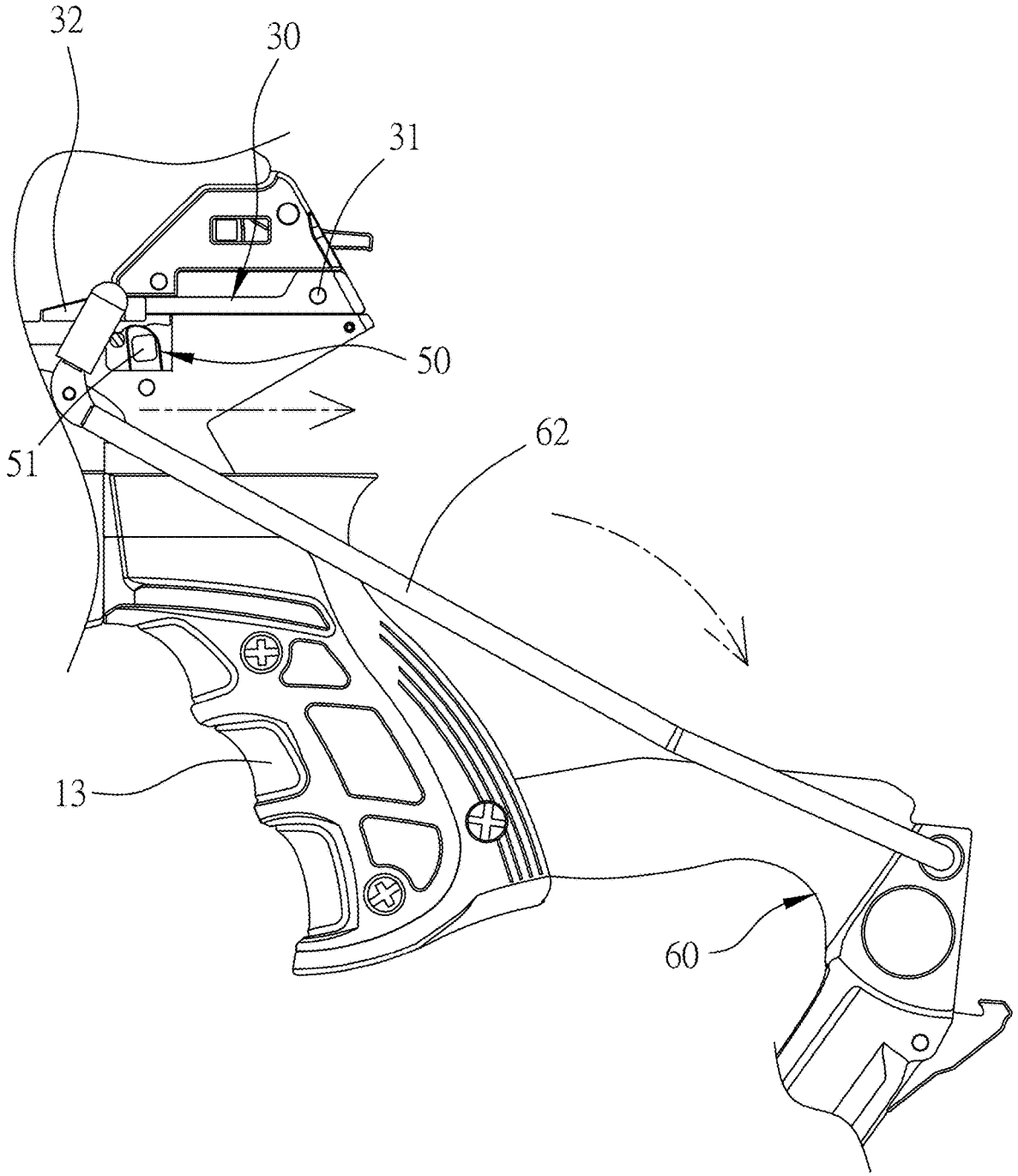
FIG. 12 is a side plan view showing the operation of the stable arrow-dropping structure according to the preferred embodiment of the present invention.

Normally, the two pull bars 62 of the string puller 60 pull the bowstring 12 continuously along the two guide grooves 16 until the two pull bars 62 abut against the two pushed portions 33 of the stopper 30, as shown in FIGS. 12 and 13, then the two pull bars 62 push the stopper 30 to move to the releasing position 30B from the stopping position 30A so that the two stop arms 32 of the stopper 30 remove from the two fletchings 222 of the bottommost arrow 22 of the arrow magazine 20, and the bottommost arrow 22 of the arrow magazine 20 drops to the slide rail 23 to put the arrow, wherein the two pull bars 62 push the safety switch 50 to shift to the opening position 50B from the closing position 50A, as illustrated in FIGS. 14-17, and the butt stock 14 actuates the string puller 60 to move reversely so that the stopper 30 returns back to an original position, and the two stop arms 32 of the stopper 30 stop the two fletchings 222 of the corresponding arrow 22 to avoid a dropping of the corresponding arrow 22, then the two pull bars 62 of the string puller 60 return back to an original position along the two guide grooves 16. Thereafter, the fastening sheet 61 of the string puller 60 is engaged on the bow 10 again to finish a bow drawing and an arrow cocking, thus obtaining a standby of shooting.

Accordingly, the stable arrow-dropping structure of the arrow magazine has advantages as follows:

In operation, when the bowstring 12 is pulled halfway and released, the bottommost arrow 22 of the arrow magazine 20 is not actuated by the bowstring 12 to move forward, hence an abrasion of the bottommost arrow 22 is decreased, and the bottommost arrow 22 is not blocked in the arrow magazine 20, thus shooting the arrow smoothly and enhancing a using convenience and safety.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A stable arrow-dropping structure of an arrow magazine comprising:

a bow including a fixing platform and a bowstring passing above the fixing platform;

an arrow magazine including a front end and a rear end and being received in a top of the fixing platform of the bow, wherein the arrow magazine includes a receiving channel extending from a top to a bottom of the arrow magazine so as to accommodate multiple arrows, a respective one arrow has a point formed on an end thereof and two fletchings formed on the other end of the respective one arrow, the arrow magazine also includes a slide rail formed between the arrow magazine and the fixing platform so as to slide the bowstring in the slide rail;

a stopper disposed on the bow and being controlled to move between a stopping position and a releasing position, wherein when the stopper is located at the stopping position, the stopper stops the two fletchings of the respective one arrow of the arrow magazine to prevent a dropping of the bottommost arrow; and a returning means configured to abut against the stopper so as to maintain the stopper at the stopping position normally.

2. The stable arrow-dropping structure as claimed in claim 1, wherein the arrow magazine includes a cutout facing the rear end of the arrow magazine and communicated with the receiving channel, the stopper includes two stop arms facing two bow limbs and accommodated in the cutout of the arrow magazine, and two pushed portions extending out of two sides of the bow.

3. The stable arrow-dropping structure as claimed in claim 1 further comprises a safety switch and a string puller;

wherein the bow further includes a butt stock and a grip;

wherein the safety switch is fixed below the stopper and is controlled to shift between a closing position and an opening position, the string puller is connected between the grip and the butt stock to pull the string tightly, and the string puller is configured to drive the stopper to move to the releasing position and to shift the safety switch to the opening position.

4. The stable arrow-dropping structure as claimed in claim 3, wherein the bow includes two guide grooves defined on two sides thereof, the stopper includes a defining post inserted through, and the string puller includes a fastening sheet and two pull bars, wherein the fastening sheet is engaged on the bow and is fixed to stop the defining post of the stopper, such that the stopper is mounted at the stopping position to avoid an abnormal operation of the stopper, wherein the two pull bars are rotatably received and slide in the two guide grooves of the two sides of the bow.

5. The stable arrow-dropping structure as claimed in claim 3, wherein the arrow magazine includes a cutout facing the rear end of the arrow magazine and communicated with the receiving channel, the stopper includes two stop arms facing two bow limbs and accommodated in the cutout of the arrow magazine, and two pushed portions extending out of two sides of the bow.

6. The stable arrow-dropping structure as claimed in claim 3, wherein the safety switch includes two columns extending out of two sides of the bow.

7. A stable arrow-dropping structure of an arrow magazine comprising:

an arrow magazine including a front end and a rear end, wherein the arrow magazine includes a receiving channel extending from a top to a bottom of the arrow magazine so as to accommodate multiple arrows, a respective one arrow has a point formed on an end thereof and facing the front end of the arrow magazine, two fletchings formed on the other end of the respective one arrow and facing the rear end of the arrow magazine, and a slide rail is formed between the arrow magazine and a fixing platform;

a stopper disposed adjacent to a lower section of a rear end of the receiving channel of the arrow magazine and being controlled to move between a stopping position and a releasing position, wherein when the stopper is located at the stopping position, the stopper stops the two fletchings of the respective one arrow of the arrow magazine to prevent a dropping of the bottommost arrow; and a returning means configured to abut against the stopper so as to maintain the stopper at the stopping position normally.

8. The stable arrow-dropping structure as claimed in claim 7, wherein the arrow magazine includes a cutout facing the rear end of the arrow magazine and communicated with the receiving channel, the stopper includes two stop arms facing the front end of the arrow magazine and accommodated in the cutout of the arrow magazine, and two pushed portions.

* * * * *